US005634184A

United States Patent [19]

Dalal et al.

[11] Patent Number: 5,634,184

[45] Date of Patent: May 27, 1997

[54] SINGLE ROLL RAM SYSTEM W/ROTATING WICK

[75] Inventors: Edul N. Dalal, Webster; Robert M. Jacobs, Ontario; Alvin D. Kromm, Jr., Webster, all of N.Y.

[73] Assignee: Xerox Corporation, Stamford, Conn.

[21] Appl. No.: 509,919

[22] Filed: Aug. 1, 1995

[51] Int. Cl.[6] ..... G03G 15/20

[52] U.S. Cl. ..... 399/325; 118/60

[58] Field of Search ..... 355/283, 284; 118/60, DIG. 1; 399/324–326

[56] References Cited

U.S. PATENT DOCUMENTS

| | | | |
|---|---|---|---|
| 3,716,221 | 2/1973 | Gorka et al. | 118/60 |
| 3,964,431 | 6/1976 | Wamiki | 118/60 |
| 4,197,445 | 4/1980 | Moser | 219/216 |
| 4,214,549 | 7/1980 | Moser | 118/60 |
| 4,397,936 | 8/1983 | Sakata et al. | 430/124 |
| 4,770,116 | 9/1988 | Moser | 118/60 |
| 5,200,786 | 4/1993 | Fromm et al. | 355/284 |
| 5,374,983 | 12/1994 | Isogai | 355/284 |

*Primary Examiner*—William J. Royer

[57] ABSTRACT

A heat and pressure fuser and RAM system therefor. A rotating wick is provided in one disclosed embodiment which cooperates with a metering roll to apply silicone oil release agent to the surface of a heated fuser roll. To this end the rotating wick contacts silicone oil contained in a sump and through its rotation conveys the oil to the metering roll which in turn applies a metered quantity of oil to the surface of the heated fuser roll. In another embodiment, a rotating wick together with a metering roll and a donor roll serve to convey silicone oil from a supply of oil to the surface of the fuser roll.

12 Claims, 3 Drawing Sheets

SINGLE ROLL RAM SYSTEM W/ROTATING WICK

BACKGROUND OF THE INVENTION

This invention relates generally to electrophotographic printing and more particularly relates to the heat and pressure fixing of particulate thermoplastic particles such as toner by direct contact with a heated fusing member. More specifically, the present invention relates to a release agent management (RAM) system for use with a heat and pressure fuser.

In imaging systems commonly used today, a charge retentive surface is typically charged to a uniform potential and thereafter exposed to a light source to thereby selectively discharge the charge retentive surface to form a latent electrostatic image thereon. The image may comprise either the discharged portions or the charged portions of the charge retentive surface. The light source may comprise any well known device such as a light lens scanning system or a laser beam. Subsequently, the electrostatic latent image on the charge retentive surface is rendered visible by developing the image with developer powder referred to in the art as toner. The most common development systems employ developer which comprises both charged carrier particles and charged toner particles which triboelectrically adhere to the carrier particles. During development, the toner particles are attracted from the carrier particles by the charged pattern of the image areas of the charge retentive surface to form a powder image thereon. This toner image may be subsequently transferred to a support surface such as plain paper to which it may be permanently affixed by heating or by the application of pressure or a combination of both.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is provided with an abhesive material layer, such as a silicone rubber or other low surface energy material, for example, tetrafluoroethylene resin sold by E. I. DuPont De Nemours under the trademark Teflon.

Oil release fluids such as silicone based oils have been applied to the aforementioned surface of the low surface energy layer to both minimize offsetting and to facilitates stripping. See, for example, U.S. Pat. No. 3,964,431. When the fuser system is one which provides for applying silicone oil to silicone rubber or "Viton" a low viscosity silicone oil (i.e. on the order of 100–1000 cs) has most commonly been employed. Donor roll RAM (release agent management) systems have been used as part of heat and pressure roll fusers apparatus for some time. Such a RAM system is disclosed in U.S. Pat. No. 4,214,549 issued on Jul. 29, 1980 to Rabin Moser. This patent illustrates a heat and pressure roll fusing apparatus for fixing toner images to copy substrates wherein the toner comprises a thermoplastic resin. The heated fuser roll is characterized by an outer layer or surface which by way of example is fabricated from a silicone rubber or Viton material to which a low viscosity polymeric release fluid is applied. Release fluid is contained in a sump from which it is dispensed by means of a metering roll and a donor roll, the former of which contacts the release fluid in the sump and the latter of which contacts the surface of the heated fuser roll.

U.S. Pat. No. 3,716,221 issued on Feb. 13, 1973 to Gorka et al discloses a heat and pressure fuser roll wherein the heated fuser roller includes a fusing roller having a resilient fusing blanket supported on the periphery thereof and heating means to heat the fusing blanket to a temperature sufficient to fuse the particulate material on a copy sheet. A backup roller is urged toward engagement with the deformable fusing blanket to press the receptor sheet carrying the particulate material into contact with the fusing roller. The fuser roller is coated with an offset preventing liquid which is applied thereto from the backup roller at predetermined intervals during operation of the device. The offset preventing liquid is applied to the backup roller via a wick, one end of which is immersed in a quantity of the liquid which is contained in a receptacle. The application of the liquid to the backup roller is controlled such that it is applied once every eleventh revolution of the fuser roller. In other words ten copy sheets are passed through the fuser and then the fuser and backup rollers are rotated an eleventh time without a copy sheet passing therebetween at which time the liquid is applied to the fuser roller via the wick and backup roller.

Compared to wicks, a donor roll RAM provides a significant oil uniformity microscopically on a copy and also to copies for long runs. One major disadvantage of a donor roll RAM system is it creates a major thermal load on the fuser during standby as well as during run. The power going into the RAM system at cold start was determined to be 1000 watts and greater than 200 watts during run. Another disadvantage of the donor roll RAM system is the added UMC (unit manufacturing cost) of the system which in the '549 patent comprises a metering roll, a donor roll and a wiper blade. When a wick is used to apply the liquid to the pressure roller, as in the case of the '221 patent, the liquid is applied as drops or droplets rather than in a thin layer. Not only is it desirable to have a RAM system that uniformly applies the release agent material to the heated fuser roll without draining heat therefrom, it is likewise desirable to reduce the UMC of RAM systems by minimizing the number of components utilized therefor.

U.S. Pat. No. 4,770,116 granted Rabin Moser on Sep. 13, 1988 discloses a heat and pressure roll fusing apparatus for fixing toner images to copy substrates, the toner comprising a thermoplastic resin. The apparatus includes an internally heated fuser roll cooperating with an unheated bare metal backup or pressure roll to form a nip through which the copy substrates pass with the images contacting the heated roll. The heated fuser roll is characterized by a conformable outer layer or surface which by way of example is fabricated from a silicone rubber or "Viton" material to which a low viscosity polymeric release fluid is applied. Release fluid is contained in a sump and the pressure roll is partially immersed in the fluid. Thus unlike the '549 RAM system, the release fluid is applied to the surface of the internally heated fuser roll via the bare metal pressure roll. The roll structures are such as to provide maximum area of contact in the nip, while minimizing the area of contact between the pressure roll and the copy substrates. In other words, the RAM system does not directly contact the heated fuser roll. Although the problem of the RAM system acting as a heat sink is obviated by the '116 arrangement, it does not provide the attributes of a donor roll RAM system such as that depicted in the '549 patent.

U.S. Pat. No. 4,397,936 granted to Sakata et al on Aug. 9, 1983 discloses a RAM system comprising an applicator roller, supply of silicone and a member for conveying the oil from the supply to the applicator roll on an intermittent basis. The applicator contacts a non-heated fixing roller the equivalent of one revolution thereof for each copy to be fused.

U.S. Pat. No. 4,197,445 discloses a heat and pressure roll fusing apparatus in which an oil applicator roll contacts a heated fuser roll member.

While a donor roll RAM system of the type disclosed in the '549 patent is superior to one that uses a wick, such a system is not devoid of shortcomings. For example, metering blade contamination causes oil streaks, metering blade contamination being the direct result of contamination of the wick utilized in a donor roll RAM system. Wick contamination is caused by the wick collecting clay and toner particles in the space between the wick and the metering roll of the donor roll RAM, and/or wear of the wick surface.

BRIEF SUMMARY OF THE INVENTION

In accordance with the present invention, a rotating wick is provided for conveying release agent oil such as silicone oil from a sump of oil to the surface of a metering roll. Rotation of the wick results in presenting a clean portion of the wick to the metering roll. The contaminates which are picked up by the wick when it contacts the metering roll surface are removed as a contaminated wick portion moves through the bath of oil contained in the sump. Thus, the rotating wick remains essentially free of contaminates. The contaminates which are removed in the foregoing manner settle to the bottom of the oil sump instead of ultimately causing metering blade contamination.

Another advantage of the rotating wick over a stationary wick of the type used in the '549 patent is that it minimizes the adverse effect of machine tilt. When a machine which uses such a RAM system is installed in a tilted position, the wick does not properly contact the oil in the oil sump. In other words, one end or the other of the wick does not contact the oil resulting in a nonuniform oil distribution in the area of contact between the wick and the metering roll. Another consequence of a tilted machine is that the oil level in the sump may be above the area of contact between the metering blade and the metering roll. Oil which is above or beyond that area will not be metered resulting in oil puddling on the heated fuser roll and, therefore, oil streaks on the final image substrate.

Still another advantage of the rotating wick is that it permits direct contact of a heated fuser member with the metering roll. Thus, the donor roll is not required in order to provide a thermal barrier between the heated fuser member and the oil in the sump. The rotating wick together with the metering roll provides suitable thermal insulation thereby minimizing oil degradation due to heat from the heated fuser member.

DETAILED DESCRIPTION OF THE PREFERRED EMBODIMENT(S) OF THE INVENTION

Figure 1:
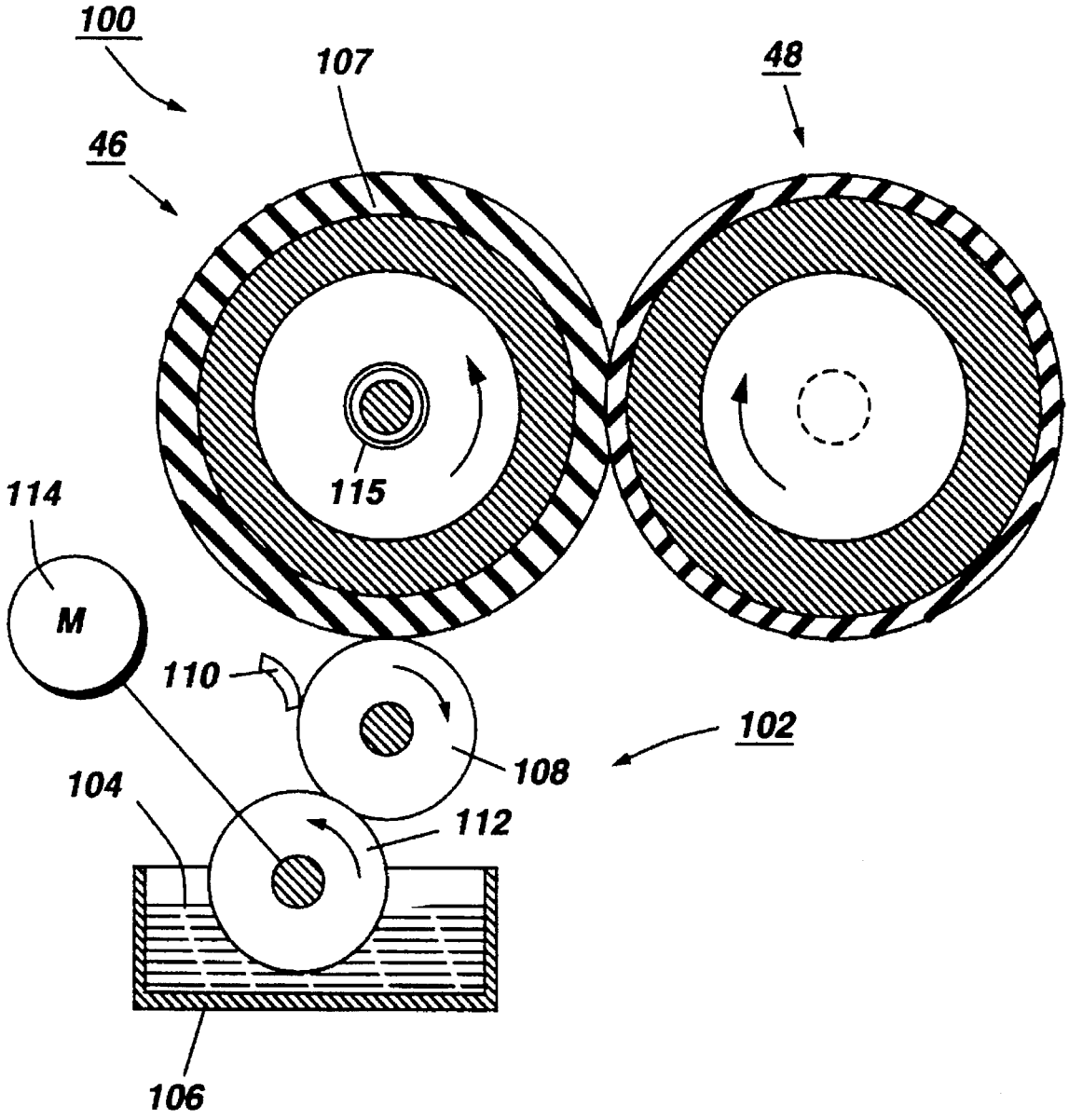
FIG. 1 is a schematic illustration of a heat and pressure roll fuser and release agent management system therefor.

For a general understanding of the features of the present invention, reference is made to the drawings. In the drawings, like reference numerals have been used throughout to identify identical elements.

Figure 3:
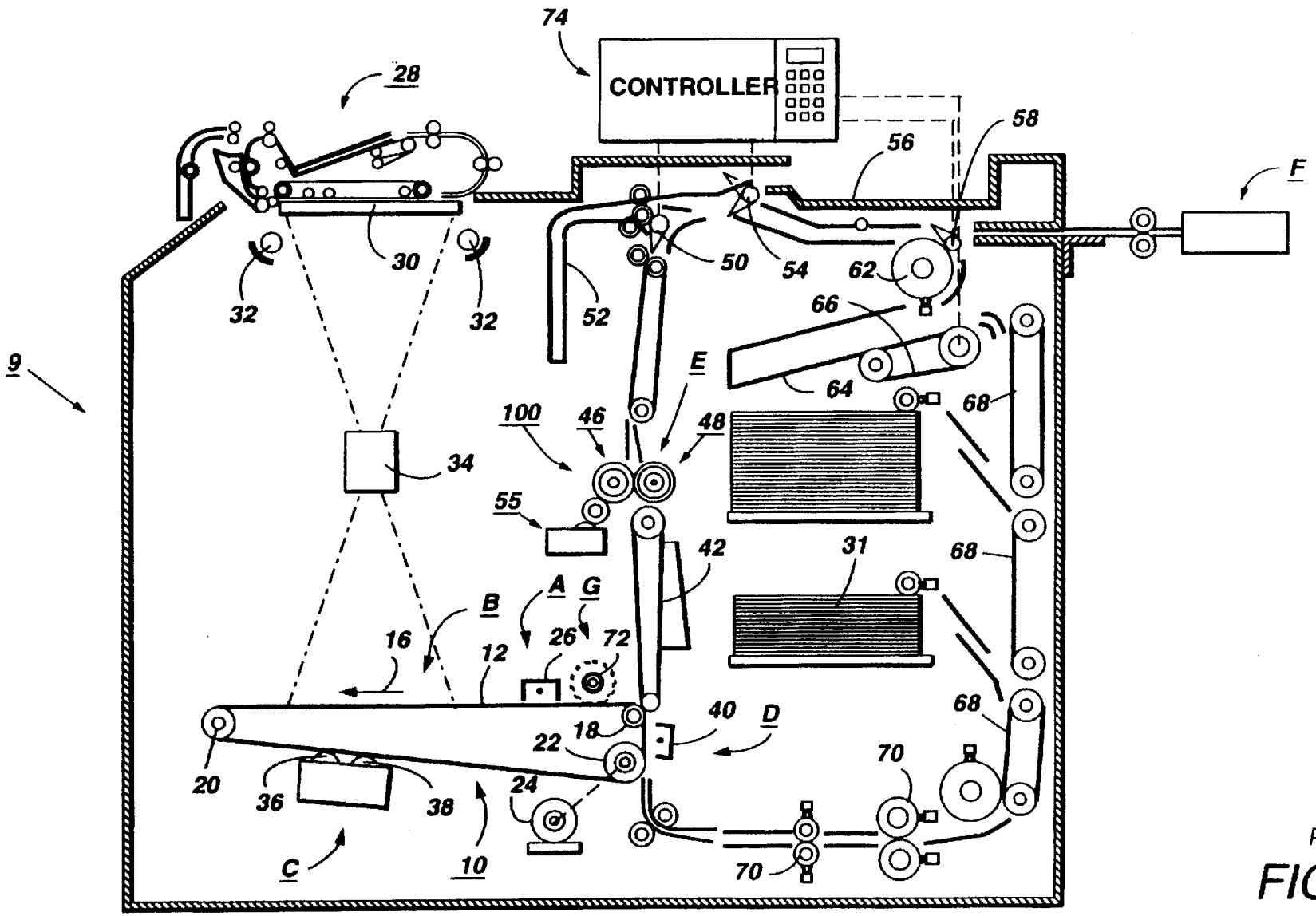
PRIOR ART FIG. 3
FIG. 3 is a schematic illustration of a prior art printing apparatus in which the specific features of the invention may be employed.

Referring to FIG. 3 of the drawings, the electrophotographic printing machine 9 employs a belt 10 having a photoconductive surface 12 deposited on a conductive substrate, not shown. Belt 10 moves in the direction of arrow 16 to advance successive portions of the photoconductive surface sequentially through the various processing stations disposed about the path of movement thereof. Belt 10 is entrained about stripping roller 18, tensioning roller 20, and drive roller 22. Stripping roller 18 is mounted rotatably so as to rotate with belt 10. Tensioning roller 20 is resiliently urged against belt 10 to maintain belt 10 under the desired tension. Drive roller 22 is rotated by motor 24 coupled thereto by suitable means such as a belt drive. As roller 22 rotates, it advances belt 10 in the direction of arrow 16.

Initially, a portion of photoconductive belt passes through a charging station A. At charging station A, a corona generating device, indicated generally by the reference numeral 26, charges photoconductive surface 12 of belt 10 to a relatively high, substantially uniform potential.

Next, the charged portion of photoconductive surface 12 is advanced through an imaging station B. At imaging station B, a document handling unit, indicated generally by the reference numeral 28, is positioned over platen 30 of the printing machine. Document handling unit 28 sequentially feeds documents from a stack of documents placed by the operator faceup in a normal forward collated order in a document stacking and holding tray. A document feeder located below the tray forwards the bottom document in the stack to a pair of take-away rollers. The bottom document is then fed by the rollers to a feed roll pair and belt. The belt advances the document to platen 30. After imaging, the original document is fed from platen 30 by the belt into a guide and feed roll pair. The document then advances into an inverter mechanism and back to the document stack through the feed roll pair. A position gate is provided to divert the document to the inverter or to the feed roll pair. Imaging of a document is achieved using lamps 32 which illuminate the document on platen 30. Light rays reflected from the document are transmitted through lens 34. Lens 34 focuses light images of the original document onto a uniformly charged portion of photoconductive surface 12 of belt 10 to selectively dissipate the charge thereon. This records an electrostatic latent image on photoconductive surface 12 which corresponds to the informational area contained within the original document. Obviously, electronic imaging of page image information could be facilitated by a printing apparatus utilizing electrical imaging signals. The printing apparatus can be a digital copier including an input device such as a Raster Input Scanner (RIS) and a printer output device such as a Raster Output Scanner (ROS), or, a printer utilizing only a printer output device such as a ROS.

Thereafter, belt 10 advances the electrostatic latent image recorded on photoconductive surface 12 to development station C. At development station C, a pair of magnetic brush developer rolls indicated generally by the reference numerals 36 and 38, advance developer material into contact with the electrostatic latent image. The latent image attracts toner particles from the carrier granules of the developer material to form a toner powder image on photoconductive surface 12 of belt 10. Belt 10 then advances the toner powder image to transfer station D.

Prior to reaching transfer station D, a copy sheet 31 is placed in proper lateral edge alignment. At transfer station D, a copy sheet is moved into contact with the toner powder image. Transfer station D includes a corona generating device 40 which sprays ions onto the backside of the copy sheet. This attracts the toner powder image from photoconductive surface 12. After transfer, conveyor 42 advances the copy sheet to fusing station E.

Fusing station E includes a fuser assembly, indicated generally by the reference numeral 100, which permanently affixes the transferred toner powder image to the copy sheet. Fuser assembly 100 includes a heated fuser roller 46 and a back-up roller 48 with the powder image on the copy sheet contacting fuser roller 46. The pressure roller is cammed against the fuser roller to provide the necessary pressure to fix the toner powder image to the copy sheet. The fuser roll is internally heated by a quartz lamp. A release agent management system 55 is provided for applying a liquid release agent such as silicone oil to the surface of the fuser roll 46. The release agent management (RAM) system 55 includes a donor roll, metering roll and a stationarily mounted wick similar to that disclosed in the '549 patent.

After fusing, the copy sheets are fed to gate 50 which functions, as an inverter selector. Depending upon the position of gate 50, the copy sheets are deflected to sheet inverter 52 or are fed directly to a second decision gate 54. At gate 54, the sheet is in a faceup orientation with the image side, which has been fused, faceup. If inverter path 52 is selected, the opposite is true, i.e. the last printed side is facedown. Decision gate 54 either deflects the sheet directly into an output tray 56 or deflects the sheet to decision gate 58. Decision gate 58 may divert successive copy sheets to duplex inverter roll 62, or onto a transport path to finishing station F. At finishing station F, copy sheets are stacked in a compiler tray and attached to one another to form sets. The sheets are attached to one another by either a binding device or a stapling device. In either case, a plurality of sets of documents are formed in finishing station F. When decision gate 58 diverts the sheet onto inverter roll 62, roll 62 inverts and stacks the sheets to be duplexed in duplex tray 64. Duplex tray 64 provides an intermediate or buffer storage for those sheets that have been printed on one side and on which an image will be subsequently printed on the second, opposed side thereof, i.e. the sheets being duplexed. The sheets are stacked in duplex tray facedown on top of one another in the order in which they are copied.

In order to complete duplex copying, the simplex sheets in tray 64 are fed, in seriatim, by bottom feeder 66 from tray 64 back to transfer station D via conveyors 68 and rollers 70 for transfer of the toner powder image to the opposed sides of the copy sheets. Inasmuch as successive bottom sheets are fed from duplex tray 64, the proper or clean side of the copy sheet is positioned in contact with belt 10 at transfer station D so that the toner powder image is transferred thereto. The duplex sheet is then fed through the same path as the simplex sheet to be stacked in tray 56 or, when the finishing operation is selected, to be advanced to finishing station F.

Invariably, after the copy sheet is separated from photoconductive surface 12 of belt 10, some residual particles remain adhering thereto. These residual particles are removed from photoconductive surface 12 at cleaning station G. Cleaning station G includes a rotatably mounted fibrous or electrostatic brush 72 in contact with photoconductive surface 12 of belt 10. The particles are removed from photoconductive surface 12 of belt 10 by the rotation of brush 72 in contact therewith. Subsequent to cleaning, a discharge lamp (not shown) floods photoconductive surface 12 to dissipate any residual electrostatic charge remaining thereon prior to the charging thereof for the next successive imaging cycle.

The various machine functions are regulated by a controller 74. Controller 74 is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. The paper path signature analysis apparatus of the present invention can be utilized to keep track of the position of the documents and the copy sheets. In addition, controller 74 regulates the various positions of the decision gates depending upon the mode of operation selected. Thus, when the operator selects the finishing mode, either an adhesive binding apparatus and/or a stapling apparatus will be energized and the decision gates will be oriented so as to advance either the simplex or duplex copy sheets to the compiler tray at finishing station F.

According to the present invention as shown in FIG. 1 of the drawings, a RAM system 102 is provided for applying silicone oil 104 from a sump 106 to an elastomeric surface layer 107 of the heated fuser roll 46. The RAM system further comprises a metering roll 108 and a metering blade 110 for metering silicone oil to a desired thickness on the metering roll. A rotatable wick structure 112 supported for contact with the silicone oil in the sump and the metering roll serves to covey the former to the latter. A motor 114 operatively connected to the wick 112 serves to effect rotation thereof for accomplishing the foregoing. An internal heat source 115 serves in a conventional manner to elevate the surface temperature of the fuser roll 46 to its operating temperature.

Figure 2:
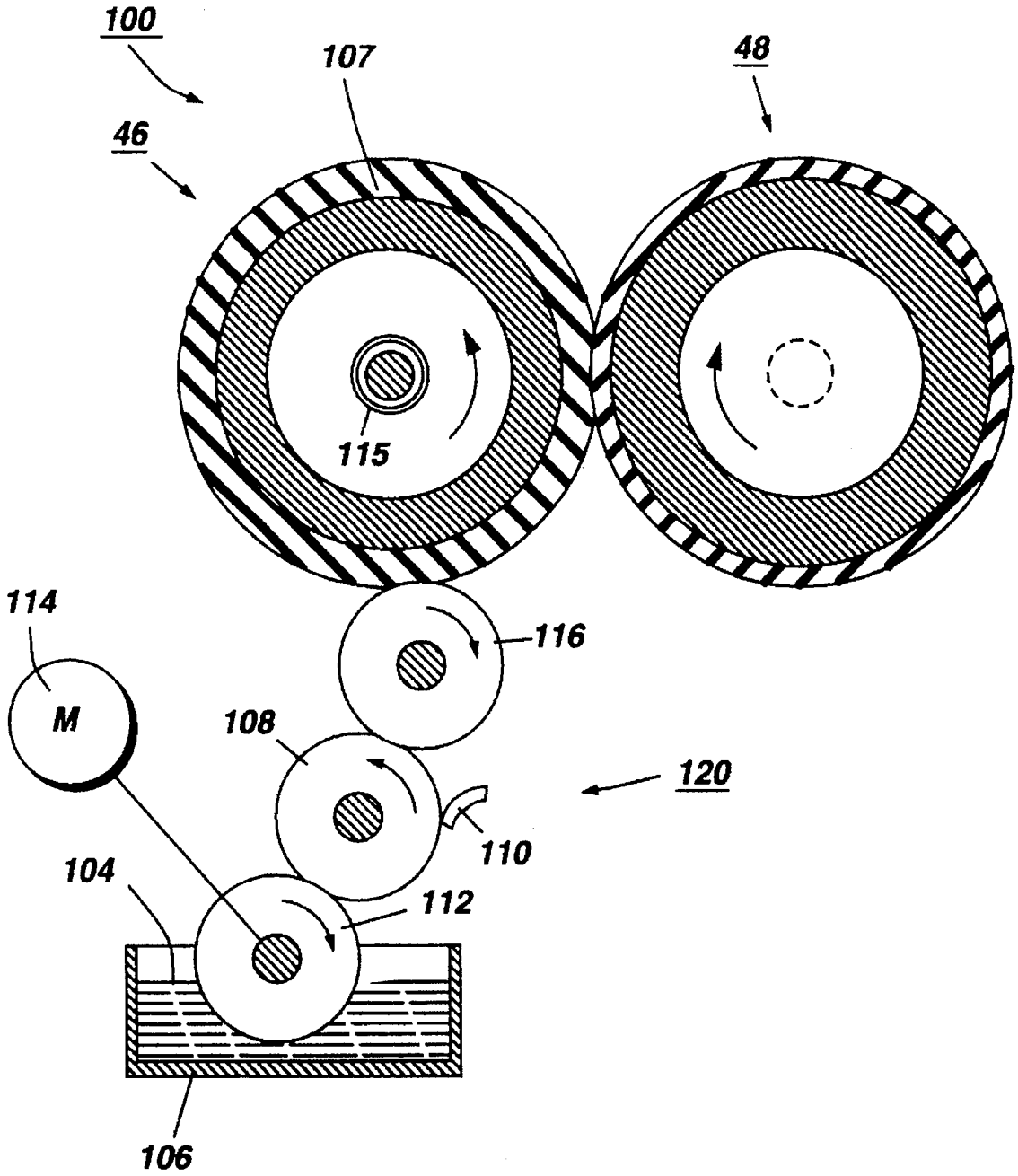
FIG. 2 is a schematic illustration of a heat and pressure roll fuser and an alternative embodiment of the release agent management system illustrated in FIG. 1.

A modified RAM system 120 shown FIG. 2 comprises in addition to the wick 112 and metering roll 108 a donor roll 116. In this embodiment, the oil is conveyed from the sump to the metering roll via rotating wick 112. The oil on the metering roll 108 metered by the metering blade 110 is conveyed to the donor roll 116 for transfer therefrom to the heated fuser roll 46.

What is claimed is:

1. Apparatus for fusing toner images to a substrate, said apparatus comprising:

a heated fuser member;

a pressure member cooperating with said heated fuser member to apply pressure to a copy substrate passing therebetween;

a supply of release agent material;

a release agent management system for conveying release fluid from said supply of release agent material to one of said members;

said release agent management system comprising a member contacting said release agent material and another member contacting said one of said members, said member contacting said one of said members comprising a cylindrically shaped wick supported for rotation; and means for effecting removal of contaminates from said member contacting said release agent material said means for effecting removal comprising means for imparting motion to said member contacting said release agent material.

2. Apparatus according to claim 1 wherein said means for effecting removal comprises a motor for effecting rotation of said cylindrically shaped wick.

3. Apparatus according to claim 2 wherein said member contacting said one of said members comprises a cylindrically shaped metering roll.

4. Apparatus according to claim 2 including a blade member for metering release agent material to a predetermined thickness on said member contacting said one of said members.

5. Apparatus according to claim 4 wherein said one of said members comprises said heated fuser member.

6. Apparatus according to claim 5 wherein said heated fuser member comprises a roll member.

7. A release agent management system for conveying release agent material from a sump to the surface of a fusing member, said system comprising:

a supply of release agent material;

a member contacting said release agent material and another member contacting said fusing member, said member contacting said fusing member comprising a cylindrically shaped wick supported for rotation; and means for effecting removal of contaminates from said member contacting said release agent material, said means for effecting removal comprising means for imparting motion to said member contacting said release agent material.

8. A release agent management system according to claim 7 wherein said means for effecting removal comprises a motor for effecting rotation of said cylindrically shaped wick through said release agent material.

9. A release agent management system according to claim 8 wherein said member contacting said fusing member comprises a cylindrically shaped metering roll.

10. A release agent management system according to claim 9 including a blade member for metering release agent material to a predetermined thickness on said metering roll.

11. A release agent management system according to claim 10 wherein said fusing member comprises a heated fuser member.

12. A release agent management system according to claim 11 wherein said heated fuser member comprises a roll member.

* * * * *